US009981792B2

(12) United States Patent
Eberhardt et al.

(10) Patent No.: US 9,981,792 B2
(45) Date of Patent: May 29, 2018

(54) PACKAGE FOR HUMANITARIAN EFFORTS WITH UNIQUE RECLOSING MECHANISM

(71) Applicants: Erich Eberhardt, Grayson, GA (US); Perry S. Keifer, Flowery Branch, GA (US); William S. Perell, San Francisco, CA (US)

(72) Inventors: Erich Eberhardt, Grayson, GA (US); Perry S. Keifer, Flowery Branch, GA (US); William S. Perell, San Francisco, CA (US)

(73) Assignee: POPPACK LLC, San Francisco, CA (US)

( * ) Notice: Subject to any disclaimer, the term of this patent is extended or adjusted under 35 U.S.C. 154(b) by 0 days. days.

(21) Appl. No.: 14/639,682

(22) Filed: Mar. 5, 2015

(65) Prior Publication Data

US 2015/0251832 A1 Sep. 10, 2015

Related U.S. Application Data

(60) Provisional application No. 61/949,361, filed on Mar. 7, 2014.

(51) Int. Cl.
*B65D 75/00* (2006.01)
*B65D 75/58* (2006.01)

(52) U.S. Cl.
CPC ..... *B65D 75/5822* (2013.01); *B65D 75/58* (2013.01); *B65D 75/5816* (2013.01); *B65D 2575/586* (2013.01)

(58) Field of Classification Search
CPC ..... B65D 75/5816; B65D 2575/586; B65D 75/5822; B65D 75/5866; Y10S 383/906
USPC ..... 383/200, 203, 204, 207, 209, 906
See application file for complete search history.

(56) References Cited

U.S. PATENT DOCUMENTS

| | | | | |
|---|---|---|---|---|
| 514,889 | A * | 2/1894 | Guilbert | 383/88 |
| 2,349,369 | A * | 5/1944 | Norseen | 383/84 |
| 2,369,716 | A * | 2/1945 | Coghill | 493/189 |
| 2,538,585 | A * | 1/1951 | Oden | 383/88 |
| 3,278,085 | A | 10/1966 | Brown | |
| 3,397,835 | A * | 8/1968 | Henning | 383/208 |
| 3,456,867 | A | 7/1969 | Repkno | |
| 3,815,810 | A * | 6/1974 | Wellman | 383/204 |
| 4,356,954 | A | 11/1982 | Mojonnier | |
| 4,428,485 | A * | 1/1984 | Egli | 383/203 |
| 4,679,701 | A | 7/1987 | Ackermann et al. | |
| 4,762,230 | A | 8/1988 | Croce | |
| 4,785,940 | A | 11/1988 | Wilson | |
| 4,902,141 | A | 2/1990 | Linnewiel | |
| 4,913,293 | A * | 4/1990 | Sanders | 383/5 |

(Continued)

FOREIGN PATENT DOCUMENTS

| | | |
|---|---|---|
| EP | 1174347 | 1/2002 |
| WO | WO94/20374 | 9/1994 |

(Continued)

OTHER PUBLICATIONS

Japanese Abstract of JP2000326990, dated Nov. 28, 2000, 1 page.
Japanese Abstract of JP20005225509, dated Aug. 25, 2005, 1 page.

*Primary Examiner* — Peter Helvey
(74) *Attorney, Agent, or Firm* — Dority & Manning, P.A.

(57) ABSTRACT

Disclosed is a consumer package that has a fin seal for reclosing the contents of the package when a remainder of the contents is present inside of the closed container.

10 Claims, 4 Drawing Sheets

(56) References Cited

U.S. PATENT DOCUMENTS

| | | | | |
|---|---|---|---|---|
| 5,078,509 | A | 1/1992 | Center et al. | |
| 5,222,813 | A * | 6/1993 | Kopp et al. | 383/200 |
| 5,228,782 | A * | 7/1993 | Imer | 383/200 |
| 5,441,198 | A | 8/1995 | McQueeny | |
| 5,441,698 | A | 8/1995 | Norell | |
| 5,518,174 | A | 5/1996 | Botterman | |
| 5,597,115 | A | 1/1997 | Reo | |
| 5,674,010 | A | 10/1997 | Dussich | |
| 5,839,831 | A | 11/1998 | Mazzocchi | |
| 5,855,315 | A | 1/1999 | Roseth | |
| 6,016,914 | A | 1/2000 | Gustafson | |
| 6,206,571 | B1 * | 3/2001 | Olin | 383/204 |
| 6,318,626 | B1 | 11/2001 | St. Pierre et al. | |
| 7,165,888 | B2 | 1/2007 | Rodick | |
| D545,689 | S * | 7/2007 | Peel | D9/707 |
| 7,438,212 | B2 | 10/2008 | Bartherl et al. | |
| 7,537,387 | B2 * | 5/2009 | Spork et al. | 383/88 |
| 7,815,098 | B2 | 10/2010 | Forman et al. | |
| 8,430,566 | B2 | 4/2013 | Brauer et al. | |
| 2003/0118254 | A1 | 6/2003 | Razeti et al. | |
| 2004/0118859 | A1 | 6/2004 | Stefandl | |
| 2005/0238262 | A1 | 10/2005 | Jenkins | |
| 2006/0110081 | A1 * | 5/2006 | Chapougnot et al. | 383/200 |
| 2006/0251341 | A1 * | 11/2006 | Sampaio Camacho | 383/62 |
| 2006/0285781 | A1 * | 12/2006 | Zoss | 383/120 |
| 2006/0291755 | A1 * | 12/2006 | Olin et al. | 383/66 |
| 2007/0221714 | A1 | 9/2007 | Ours | |
| 2008/0240629 | A1 | 10/2008 | Biller et al. | |
| 2010/0059401 | A1 | 3/2010 | Schein et al. | |
| 2010/0166342 | A1 | 7/2010 | Karagulmez | |
| 2010/0226598 | A1 * | 9/2010 | Stoeppelmann | 383/207 |
| 2011/0268372 | A1 | 11/2011 | Brauer et al. | |
| 2011/0293207 | A1 * | 12/2011 | Edwards et al. | 383/201 |
| 2013/0121623 | A1 | 5/2013 | Lyzenga et al. | |
| 2015/0251831 | A1 * | 9/2015 | Steele | 383/200 |

FOREIGN PATENT DOCUMENTS

| | | |
|---|---|---|
| WO | WO 2008/146142 | 12/2008 |
| WO | WO 2010/035279 | 4/2010 |

* cited by examiner

PACKAGE FOR HUMANITARIAN EFFORTS WITH UNIQUE RECLOSING MECHANISM

RELATED APPLICATIONS

The present application is based upon and claims priority to U.S. Provisional Patent Application Ser. No. 61/949,361, filed on Mar. 7, 2014, which is herein incorporated by reference.

BACKGROUND

Even as mankind continues to advance into the technological age, world hunger and poverty continue to be global problems. It is estimated that over 900 million people suffer from lack of food or malnutrition. Of particular concern are the number of people who lack access to any suitable food source that provides protein and energy. Protein, for instance, is necessary for key body functions including provision of essential amino acids in development and maintenance of muscles. Unfortunately, children tend to be the largest class of people that suffer from hunger and malnutrition.

In view of the above, various philanthropic efforts are currently in place to provide food to the needy and to reduce world hunger. One problem that persists, however, is an economical way to distribute food on a daily basis such that the food can provide daily requirements to the recipient without spoiling.

One solution to the above problem is to issue humanitarian daily rations. Humanitarian daily rations are food rations that are ready to eat and that are high in protein and calories. Such food rations can include packages of rice dishes, fruit pastries, jam, fig bars, vegetable crackers, and the like. Packages containing peanut butter are particularly useful since peanut butter is high in both proteins and calories.

The above food items are typically packaged in flexible packages. For instance, peanut butter is typically placed in a foil trilaminate package. For instance, the package may be comprised of three layers of material including a polyester layer, an aluminum foil layer, and a polyolefin layer. The aluminum foil layer provides an almost absolute barrier to the transfer of gases. Typically these packages contain more than one serving of the food item or, if they are intended to contain a single serving, are not consumed in a single sitting.

When the above packages are opened and the entire contents are not consumed, however, problems have been experienced in the food item spoiling, becoming contaminated with dirt, or being attacked by insects. In particular, the packages do not contain any type of closure device. Incorporating a proper closure device into the package, however, will greatly increase the cost of the package and therefore limit the amount of packages that can be delivered.

In view of the above, a need currently exists for a package for humanitarian efforts that can be closed after being opened without adding significant cost and expense to the package.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
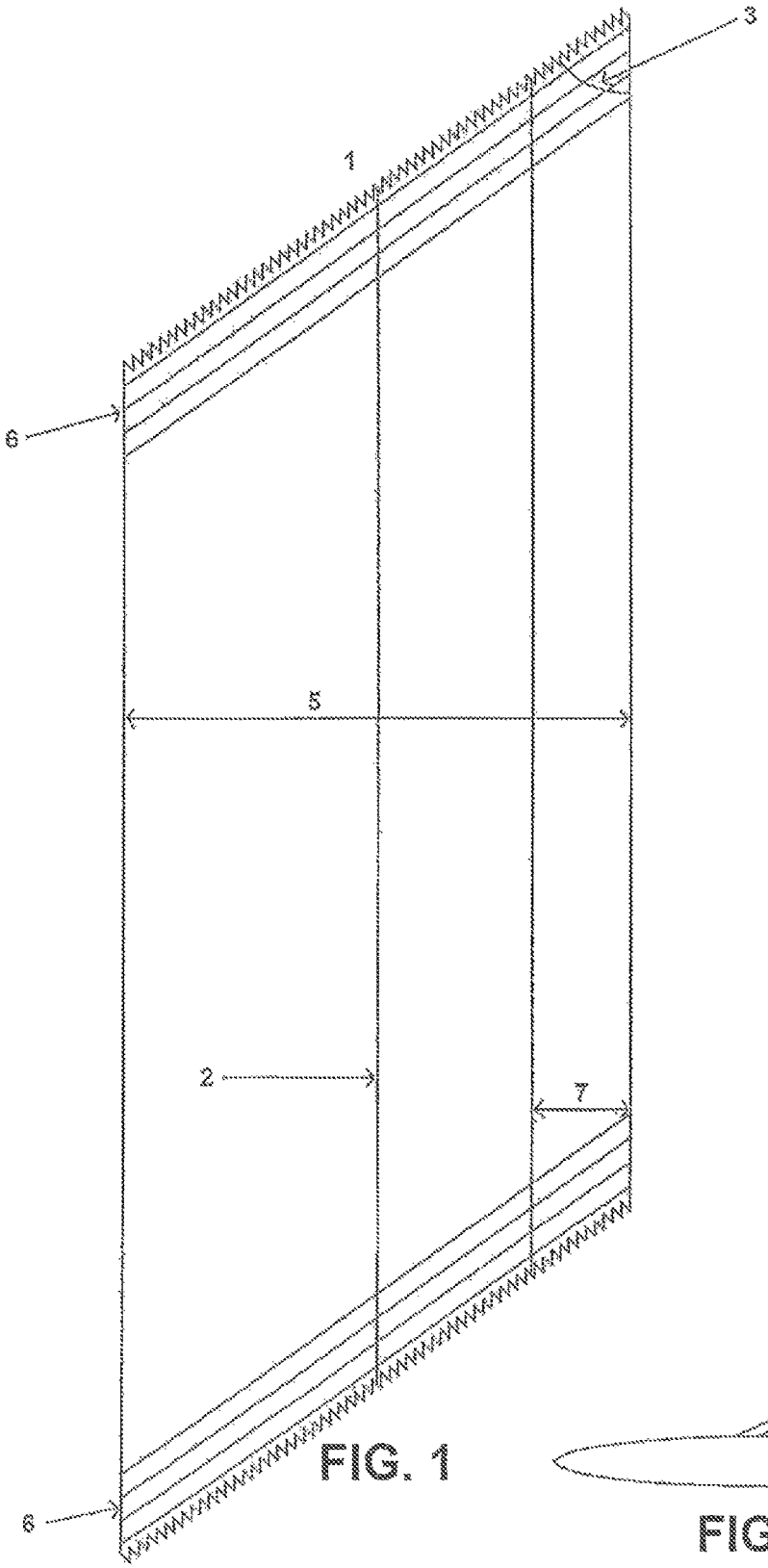
FIG. 1 is a bottom perspective view of the package.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

The present invention surmounts the deficiencies and constraints of the prior art by providing a flexible package which administers a certain amount of the contents of the package in a controlled fashion and can subsequently be reclosed to store the remainder of the contents for later use. The present disclosure is directed to providing the user with a method to consume a portion of the package contents without being forced to utilize the entirety of the contents of the package or to waste the remainder of the contents by allowing it to spoil if unused immediately after the package is opened. It is a further objective to provide a package which can comprise of an assortment of flexible materials and to provide a varying number of contents which may be contained inside of the package.

FIG. 1 is a perspective view of the underside of one embodiment of a package in accordance with the present invention. The package is comprised of a sealed container 1 which may take on a variety of shapes. As shown, the container includes a first edge 6 that is slanted with respect to a lengthwise axis extending through the container. Sealed container 1 may be comprised of any flexible material that allows the package to bend and compress such that the contents can be expelled from the container through pressure upon the walls of the sealed container 1. For instance, polyester, polystyrene, polyethylene, polypropylene, or other polymeric or plastic types of material are applicable. Additional materials such as aluminum that have a malleable property may be utilized accordingly in the present application.

Located on the underside of the sealed container 1 is a fin seal 2. A fin seal is the area of the sealed container where the two edges of the container have been sealed together lengthwise. Fin seal 2 can comprise the same material as implemented throughout sealed container 1 or instead additional materials may be utilized.

As will be described in greater detail below, the fin seal 2 has a width sufficient for an edge or a corner of the container to be folded and tucked below the fin seal. For instance, in one embodiment, the fin seal 2 has a width of at least 10 mm, such as at least 12 mm, such as at least 14 mm, such as at least 16 mm, such as at least 18 mm. In general, the fin seal has a width of less than about 60 mm, such as less than about 50 mm, such as less than about 40 mm.

In a further embodiment, fin seal 2 may be offset with respect to a lengthwise plane extending through the package, i.e. off-center. Furthermore, adhesive 12 can be present on a section of fin seal 2 in order to aid in reclosing of the container 1 and its contents. This adhesive 12 may be a varying number of compositions. For instance, it may be a polymeric-based adhesive such as that found on the underside of a credit card when received in the mail affixed to an accompanying letter. In other embodiments, the adhesive 12 may comprise double-sided tape, a pressure-sensitive adhesive, or an elastomeric material.

Figure 2:
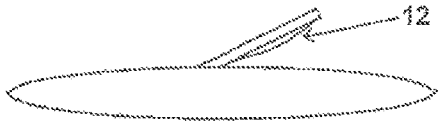
FIG. 2 is a cross-sectional perspective view of the package which shows the additional length of the fin seal and the spatial orientation of the package.

FIG. 2 is a cross sectional perspective view of the embodiment of the present invention as depicted in FIG. 1. As shown in FIG. 2, fin seal 2 is relatively wide. When construction of the sealed container 1 is taking place, fin seal 2 may be oriented such that it folds partial to one side of the packaging. Therefore, in a preferred embodiment, the acute angle 3 is place adjacent to this preferential folding such that once opened, and folded over, the fin seal 2 may easily fold over any opening with ease.

FIG. 2 illustrates the spatial orientation of the sealed container 1 when filled with contents. Adhesive 12 can be present on a section of fin seal 2 in order to aid in reclosing of the container 1 and its contents. This adhesive 12 may be a varying number of compositions.

Figure 3:
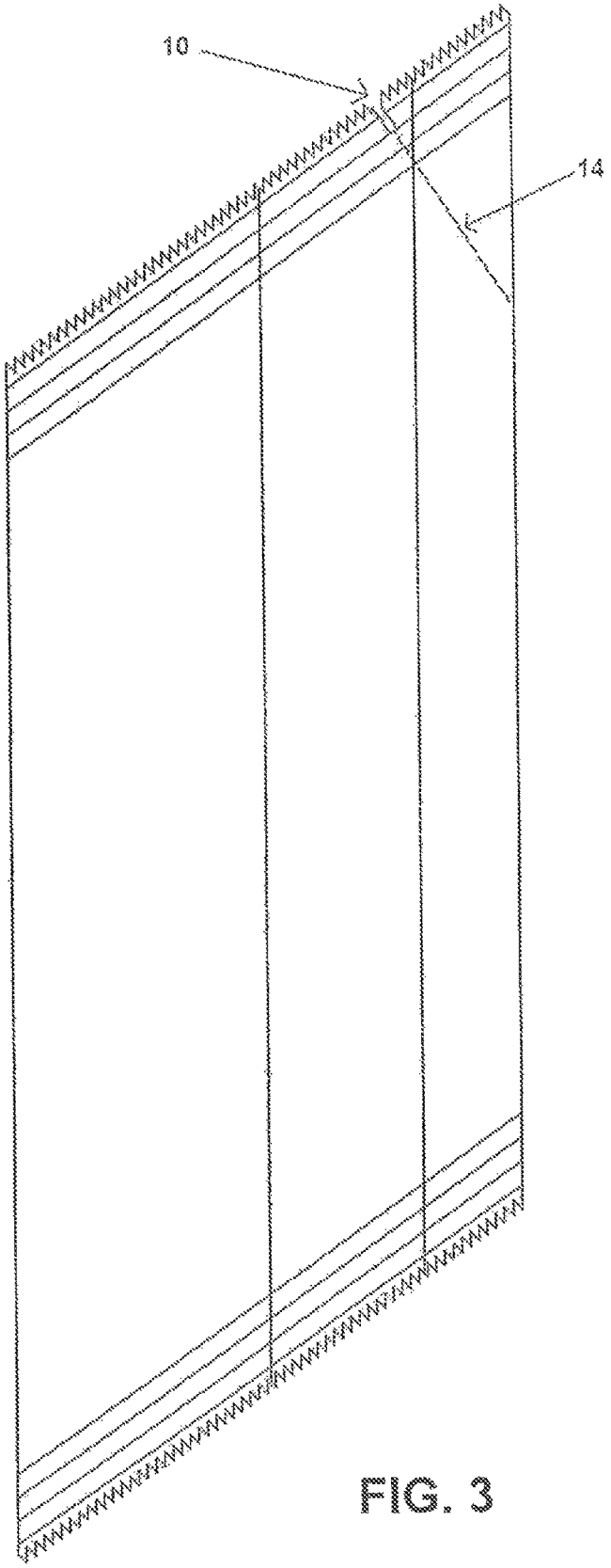
FIG. 3 is a bottom perspective view of the package which portrays a tear notch and a removable section.

FIG. 3 is an additional bottom perspective view of a further embodiment adapted from FIG. 1. As shown in FIG. 3, an opening device may be provided for facilitating opening of the container, especially near the corner of the container where the first edge 6 intersects a side edge. In the embodiment illustrated, the opening device comprises an indentation or tear notch 10 located in the acute corner 3 on the first edge 6 of the sealed container 1 to aid the user in accessing the contents of the package. Tear notch 10 allows the user to easily create an opening 20 in the acute corner 3 of sealed container 1. Acute corner 3 is present to create a sort of "funnel-like" opening through which the contents can flow. The acute corner can have an angle measure of about 15° to about 80°, such as from about 20° to about 60°. In yet a further embodiment, a series of scorelines 14 may be utilized as yet another opening device. Scoreline 14 is also placed in the acute corner of the sealed container. It further facilitates removal of the removable section 11 allowing opening 20 to be exposed, and the contents to flow therefrom.

Figure 4:
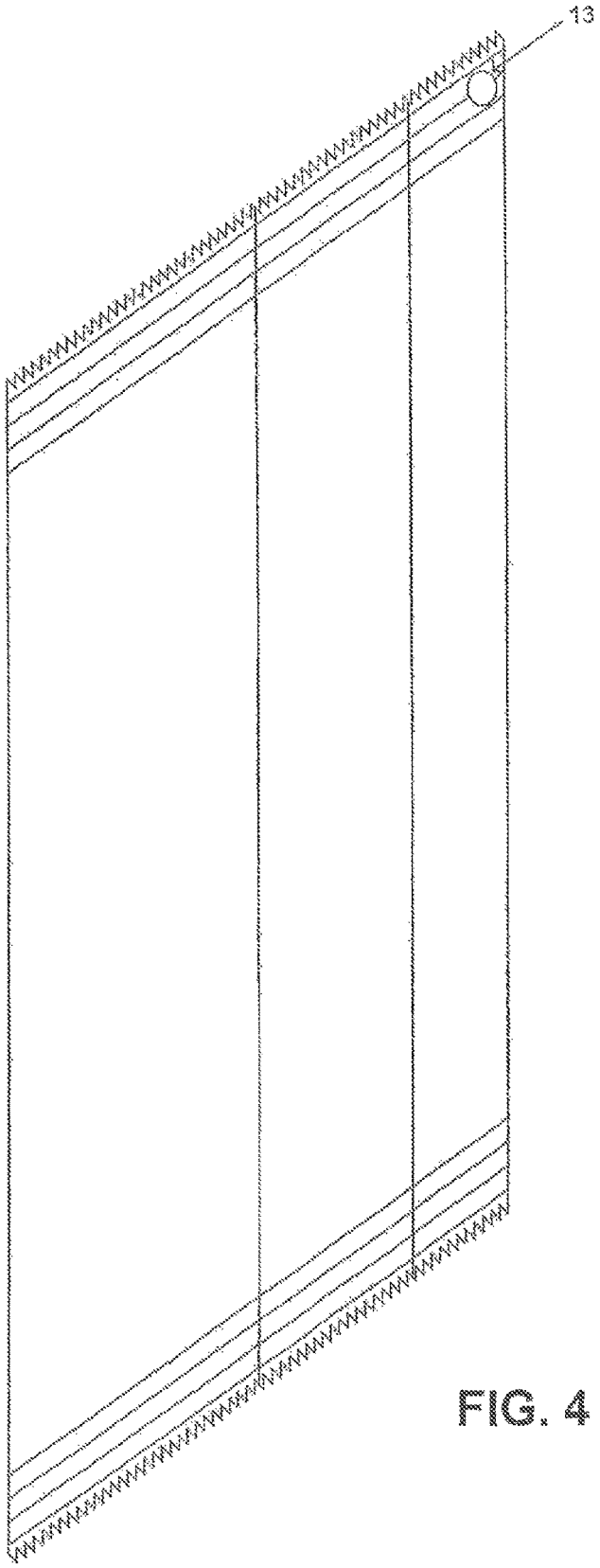
FIG. 4 is a bottom perspective view of the package which exhibits the bubble device.

FIG. 4 is a perspective view of the underside of sealed container 1. In this embodiment, a bubble device 13 has been implemented as a substitute to the indentation 10 of FIG. 3, Pressure may be applied by the user to bubble device 13 in order to access the contents of sealed container 1. Subsequently, as shown in FIG. 5, an opening 20 will be formed allowing contents to flow out of the sealed container 1, at the user's discretion.

Figure 5:
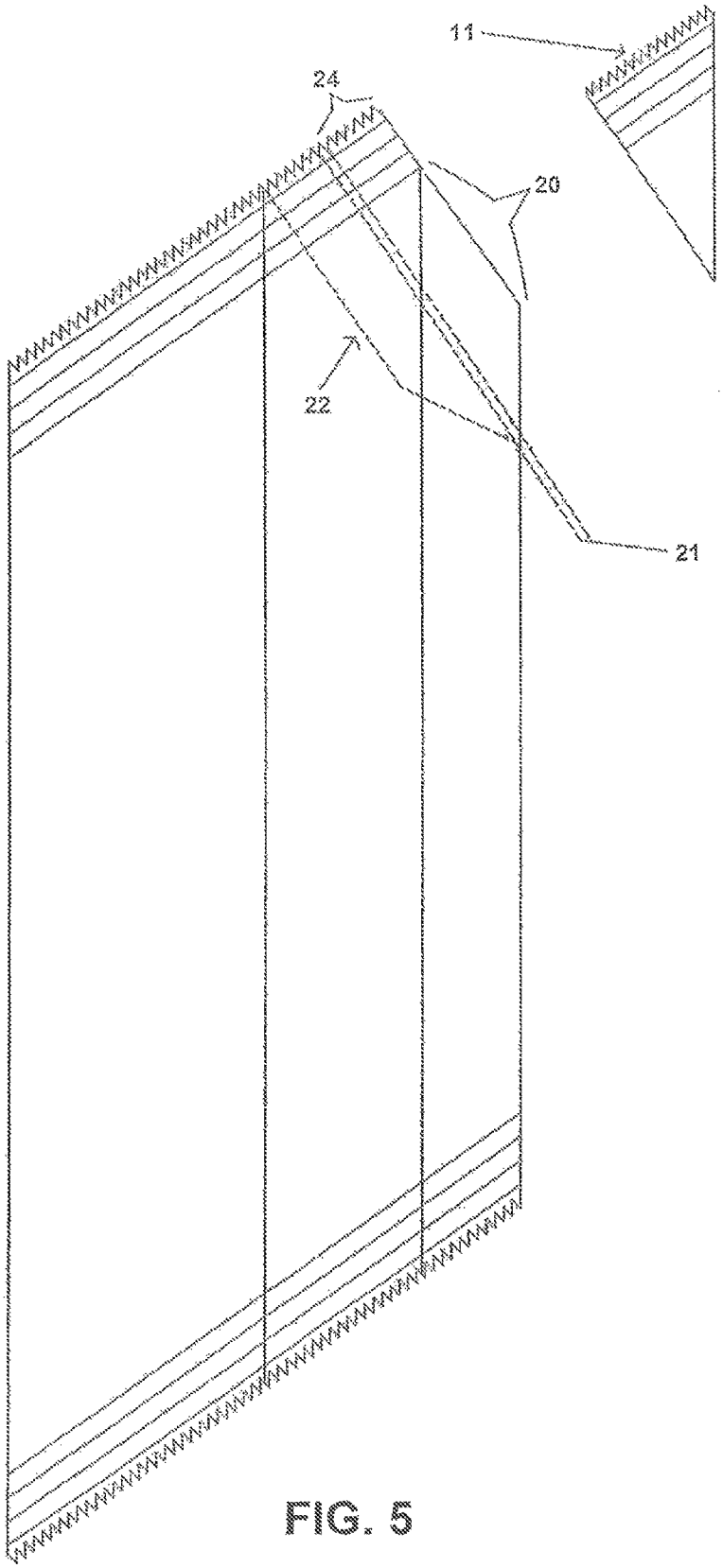
FIG. 5 is a bottom perspective view of the package after the removable section has been removed. It illustrates the foldable flap and its functions.

FIG. 5 is a further perspective view of FIG. 1 after indentation 10 has been utilized and the removable section 11 of the acute corner 3 has been removed. Removal of the removable section 11 creates an opening 20 in sealed container 1. Opening 20 allows for the movement of the contents out of the packaging by way of a "funnel-like" design to expel the contents effectively. As shown in FIG. 5, once the user has consumed a variable amount of contents from the sealed container 1, reclosing flap 24 can be folded over and tucked below the fin seal 2 such that the container 1 is reclosed. A fold line 21 can be partially impressed into the container prior to use by the user to aid in the folding process and subsequently reclosing of container 1.

Advantages of the present invention include, but not by way of limitation as to interpretation of the claims, the ability of a user to open a package with ease by utilizing the indentation, score line, or bubble device and, once open, the ability to reclose the package to save the remaining contents of the package for later use.

The sealed container is made of a flexible material such that the package can be bent and compressed to force the contents of the package out through an opening. A fin seal is also provided on the underside of the sealed container which can fold over the flap once it has been folded into place. Subsequently, the tip of the fin seal can be wrapped around the contour of the flap to yield a secure closure to lock out ambient air and thus prevent contamination of the contents. Further, an adhesive on the underside of a section of the fin seal may be present to aid in the reclosing process of the package.

The present invention therefore provides a novel and unique reclosable package that is able to dispense any type of desired contents such as semi-liquids or gel-like substances, for instance, peanut butter and the like. Additional contents can be the following, but are not limited to: granola bars, beef jerky, and the like. The packages are inexpensive and simple to produce. The packages can be easily carried and stored by the user and dispensed in a straightforward fashion using one hand or two.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A package comprising:

a sealed container including a first end and a second end, the sealed container defining a compartment in between the first end and the second end, the sealed container having a length that extends between the first end and the second end, the sealed container being formed from a flexible material comprising a polyester layer and an aluminum foil layer, the sealed container including a fin seal extending along the length of the container, the fin seal having a first side and a tip, wherein at least the first side of the fin seal is permanently attached to the container, and wherein the first end of the container has a slanted edge in relation to a lengthwise axis extending through the container, the slanted edge terminating at a side edge, and a corner formed by the intersection of the first end and the side edge, the corner having a first position that is generally in the same plane as the package and a second position that is folded toward the fin seal in a plane generally parallel to the plane of the package, wherein the fin seal has a width and a position on the container such that the tip of the fin seal extends beyond an outer edge of the corner in the folded position, the fin seal having a width from 10 mm to 60 mm, and wherein at least an inner edge of the corner in the folded position is disposed between the fin seal and the package.

2. A package as defined in claim 1, wherein the second end also has a slanted edge, the slanted edge of the first end and the slanted edge of the second end being substantially parallel.

3. A package as defined in claim 1, further comprising an adhesive material adjacent to one side of the fin seal that secures at least the inner edge of the corner in the folded position to the fin seal.

4. A package as defined in claim 1, wherein the slanted edge of the first end and the side edge form an angle of from about 15° to about 70°.

5. A package as defined in claim 1, wherein the fin seal is located on a back face of the package and is offset with respect to a lengthwise plane extending parallel to the back face of the package.

6. A package as defined in claim 1, wherein a fold line is partially impressed into the container adjacent to the corner, the corner further comprising an open portion formed at the intersection of the first edge and the side edge, the fold line being positioned such that the corner is transitioned into the second position and is disposed between the fin seal and the package such that the open portion is completely contained under the fin seal for forming the secure closure.

7. A package as defined in claim 1, wherein an item is located within the package, the item comprising peanut butter.

8. A package as defined in claim 1 further comprising an opening device located on the first edge, the side edge, or both the first edge and side edge at the intersection of the first edge and the second edge.

9. A package as defined in claim 8 further comprising an open portion, wherein the open portion corresponds to a portion of the corner that is removed by an opening device.

10. A package as defined in claim 1 wherein the fin seal has a width and a position such that the entire corner in the folded position is disposed between the fin seal and the package.

* * * * *